US009476634B2

(12) United States Patent
Choi et al.

(10) Patent No.: US 9,476,634 B2
(45) Date of Patent: Oct. 25, 2016

(54) REFRIGERATOR

(71) Applicant: LG ELECTRONICS INC., Seoul (KR)

(72) Inventors: Sungwoo Choi, Seoul (KR); Jaeyoul Lee, Seoul (KR); Junghun Kim, Seoul (KR); Seonkyu Kim, Seoul (KR); Hyun Choi, Seoul (KR); Ohseob Kwon, Seoul (KR); Kyeongchul Cho, Seoul (KR); Seungjin Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/162,921

(22) Filed: Jan. 24, 2014

(65) Prior Publication Data

US 2014/0285082 A1 Sep. 25, 2014

(30) Foreign Application Priority Data

Mar. 25, 2013 (KR) ..... 10-2013-0031379
Aug. 23, 2013 (KR) ..... 10-2013-0100202

(51) Int. Cl.
*F25D 25/00* (2006.01)
*F25D 23/04* (2006.01)
*F25D 23/02* (2006.01)
(Continued)

(52) U.S. Cl.
CPC ..... *F25D 23/04* (2013.01); *E05D 7/0009* (2013.01); *F25D 23/00* (2013.01); *F25D 23/02* (2013.01); *F25D 23/025* (2013.01); *F25D 23/028* (2013.01); *F25D 25/021* (2013.01);
(Continued)

(58) Field of Classification Search
CPC . F25D 23/02; F25D 23/028; Y10T 16/5595; E05D 5/06; E05D 2005/067
USPC ..... 312/405, 405.1, 326, 329, 324, 291, 312/321.5; 62/441, 449
See application file for complete search history.

(56) References Cited

U.S. PATENT DOCUMENTS 666,359 A 1/1901 Shroeder
1,078,703 A * 11/1913 Soss ..... 16/270
(Continued)

FOREIGN PATENT DOCUMENTS

DE 19902888 * 7/2000
DE 102005058898 * 12/2006
(Continued)

OTHER PUBLICATIONS

KR 2005071221; Dec. 31, 2003; Choi et al; figure and abstract.*
(Continued)

*Primary Examiner* — Janet M Wilkens
(74) *Attorney, Agent, or Firm* — KED & Associates, LLP

(57) ABSTRACT

A refrigerator is provided that may include a main body having a storage compartment in which food or other items may be stored, a main door configured to open or close the storage compartment, the main door having a storage chamber separate from the storage compartment, a sub door configured to open or close an opening of the storage chamber, a tray configured to be introduced into or withdrawn from the storage chamber, a guide configured to guide movement of the tray by being compressed when the tray is introduced into the storage chamber and released from compression when the tray is withdrawn from the storage chamber, and a basket placed on the tray, the basket having a storage space therein. The guide may cause variation in a moving speed of the tray when the tray is introduced into or withdrawn from the storage chamber.

18 Claims, 10 Drawing Sheets

(51) Int. Cl.
*F25D 23/00* (2006.01)
*E05D 7/00* (2006.01)
*F25D 25/02* (2006.01)

(52) U.S. Cl.
CPC ..... *F25D25/024* (2013.01); *F25D 2323/023* (2013.01); *F25D 2323/024* (2013.01)

(56) References Cited

U.S. PATENT DOCUMENTS

| | | | | | |
|---|---|---|---|---|---|
| 1,094,010 | A * | 4/1914 | Parsons | 16/379 | |
| 1,120,050 | A | 12/1914 | Goggin | | |
| 2,095,811 | A | 10/1937 | Goulooze | | |
| 2,129,862 | A * | 9/1938 | Naert | 16/389 | |
| 2,179,113 | A * | 11/1939 | Bates | 16/379 | |
| 2,207,667 | A * | 7/1940 | Holly | 108/38 | |
| 2,364,604 | A | 12/1944 | Creager | | |
| 2,638,894 | A | 5/1953 | Corn, Jr. | | |
| 3,643,464 | A | 2/1972 | Hilliker et al. | | |
| 4,087,140 | A | 5/1978 | Linstromberg | | |
| 4,586,347 | A * | 5/1986 | McCarty | F25D 17/065 | 62/265 |
| 4,609,234 | A * | 9/1986 | Naniwa et al. | 312/296 | |
| 4,800,822 | A | 1/1989 | Adkins | | |
| 8,066,342 | B2 * | 11/2011 | Hwang | 312/405.1 | |
| 8,186,782 | B2 * | 5/2012 | Choi | F25D 23/028 | 16/85 |
| 8,393,694 | B2 | 3/2013 | Ha | | |
| 2007/0267952 | A1 * | 11/2007 | Koo | 312/405.1 | |
| 2008/0289355 | A1 | 11/2008 | Kang et al. | | |
| 2009/0008403 | A1 | 1/2009 | Lee et al. | | |
| 2010/0043177 | A1 * | 2/2010 | Wildman | E05D 5/065 | 16/389 |
| 2010/0154457 | A1 * | 6/2010 | Kim et al. | 62/340 | |
| 2010/0236273 | A1 | 9/2010 | Kang et al. | | |
| 2011/0094256 | A1 * | 4/2011 | Song | F25D 23/04 | 62/441 |
| 2011/0187255 | A1 | 8/2011 | Ryu et al. | | |
| 2012/0025686 | A1 * | 2/2012 | Darney | 312/405 | |
| 2016/0061511 | A1 * | 3/2016 | Park | F25D 11/02 | 312/404 |

FOREIGN PATENT DOCUMENTS

| | | | |
|---|---|---|---|
| DE | 10 2011 003440 | A1 | 8/2011 |
| EP | 1508465 | * | 2/2005 |
| FR | 2899626 | * | 10/2007 |
| KR | 10-2006-0118897 | A | 11/2006 |
| KR | 10-0760403 | B1 | 9/2007 |
| KR | 10-2009-0105251 | A | 10/2009 |
| KR | 1020090105255 | * | 10/2009 |
| KR | 10-1036306 | B1 | 5/2011 |
| KR | 10-2013-0094032 | A | 8/2013 |
| KR | 10-1322118 | B1 | 10/2013 |
| WO | 2005038181 | * | 4/2005 |
| WO | 2008050986 | * | 5/2008 |

OTHER PUBLICATIONS

CN 201276915; Jul. 22, 2009; Cui et al; figure and abstract.*
European Search Report issued in Application No. 14152472.8 dated Mar. 5, 2015.
European Search Report issued in Application No. 14152472.8 dated Jul. 31, 2015.
U.S. Office Action issued in co-pending U.S. Appl. No. 14/848,930 dated Jan. 13, 2016.

* cited by examiner

REFRIGERATOR

CROSS-REFERENCE TO RELATED APPLICATION(S)

This application claims priority to Korean Patent Application Nos. 10-2013-0031379, filed in Korea on Mar. 25, 2013, and 10-2013-0100202, filed in Korea on Aug. 23, 2013, which are hereby incorporated by reference as if fully set forth herein.

BACKGROUND

1. Field

A refrigerator is disclosed herein.

2. Background

In general, refrigerators may be classified, based on the arrangement relationship of a freezing compartment and a refrigerating compartment, into top mount type refrigerators, side by side type refrigerators, and bottom freezer type refrigerators, for example. Top mount type refrigerators are configured such that a freezing compartment is at an upper side and a refrigerating compartment is at a lower side. Side by side type refrigerators are configured such that a freezing compartment and a refrigerating compartment are arranged next to each other at left and right sides. Bottom freezer type refrigerators, which are configured such that a refrigerating compartment is at an upper side and a freezing compartment is at a lower side, have been very popular in recent years in the United States and Europe.

An ice bank in which ice is stored may be installed in a freezing compartment in order to provide ice whenever a user so desires, and for user convenience, a dispenser may be installed to or at a front surface of a refrigerator door to contribute to easy supply of ice. According to another method of providing the user with ice, a home-bar door may be installed to or in a main door of the refrigerator, and an ice storage space may be defined inside the home-bar door to realize supply of ice as the home-bar door is vertically pivotally rotated.

Technical studies to enhance user convenience are being conducted to allow the user to easily withdraw ice stored in a tray installed inside the main door when the home-bar door is open.

BRIEF DESCRIPTION OF THE DRAWINGS

Embodiments will be described in detail with reference to the following drawings in which like reference numerals refer to like elements, and wherein.

DETAILED DESCRIPTION

Figure 1:
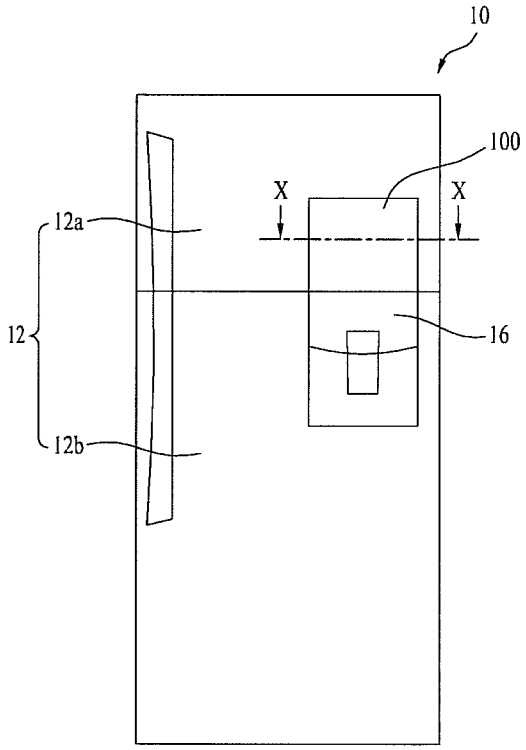
FIG. 1 is a front view of a refrigerator according to an embodiment.

Hereinafter, embodiments will be described in detail with reference to the accompanying drawings. Where possible, like reference numerals have been used to indicate like elements, and repetitive disclosure has been omitted.

In the drawings, shape, size, or the like of components may be exaggerated for clarity and convenience. In addition, terms particularly defined in consideration of configurations and operations may be replaced by other terms based on intensions of those skilled in the art or customs. The meanings of these terms may be construed based on the overall content of this specification.

Embodiments may be applied to all refrigerators including a top mount type refrigerator, a side by side type refrigerator, and a bottom freezer type refrigerator, for example. For convenience of explanation, a specific type of refrigerator will be described hereinafter.

FIG. 1 is a front view of a refrigerator according to an embodiment. A description with reference to FIG. 1 will follow.

The refrigerator according to this embodiment may include a main body 10 having a storage compartment in which food or other items may be stored, a main door 12 configured to open or close the storage compartment, and a sub door 100 rotatably installed to the main door 12.

The main door 12 may be divided into two doors 12*a* and 12*b*. The respective doors 12*a* and 12*b* may be rotated independently of each other, and may individually open or close respective storage compartments defined in the main body 10. In this case, the storage compartments to be opened or closed by the respective doors 12*a* and 12*b* may have various combinations including a freezing compartment and a refrigerating compartment or vice versa.

The door 12*b* may be provided with a dispenser 16, which may supply water or ice to a user. In this case, the user may control whether to supply water or ice from the dispenser 16 using, for example, a display device installed to or at an outer surface of the door 12*b*.

The sub door 100 may have a size smaller than an outer periphery of the door 12*a*, such that the user may rotate the sub door 100 without rotation of the door 12*a*.

Figure 2:
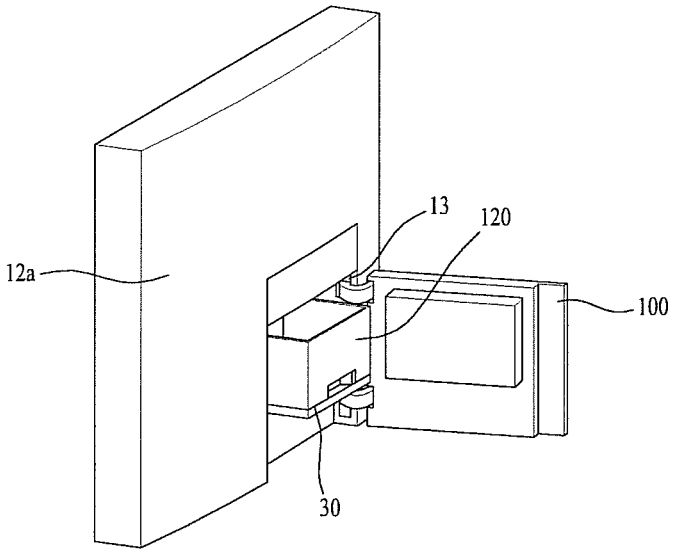
FIG. 2 is a view showing a front side of a door in a state in which a sub door is open.
Figure 3:
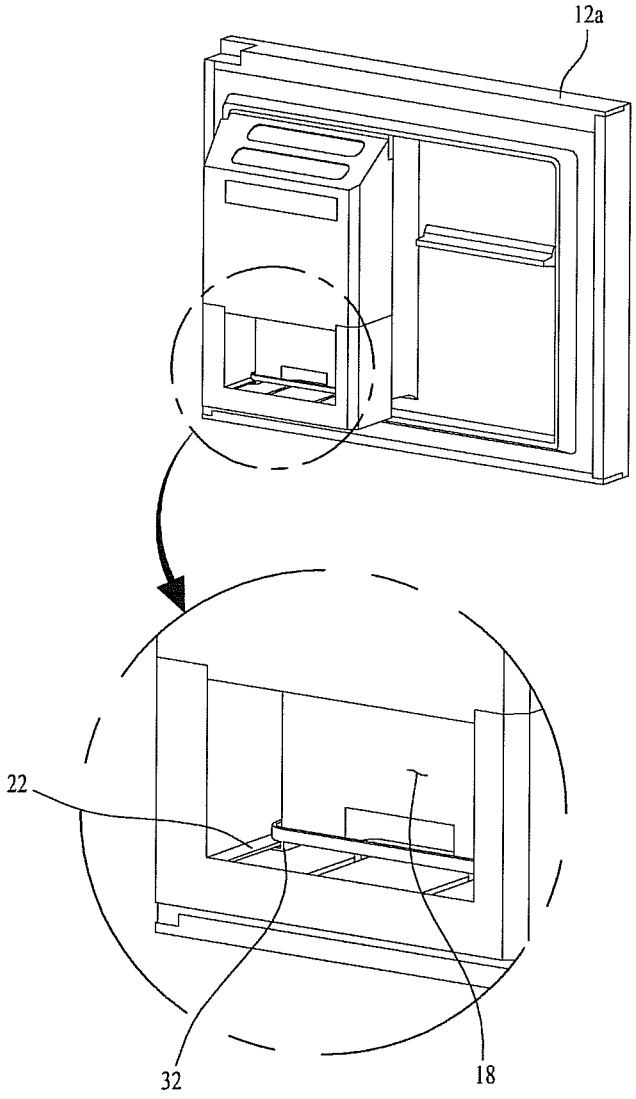
FIG. 3 is a view showing a rear side of the door of FIG. 3.

FIG. 2 is a view showing a front side of a door in a state in which a sub door is open. FIG. 3 is a view showing a rear side of the door of FIG. 3. A description with reference to FIGS. 2 and 3 will follow.

The door 12*a* may have a storage chamber 18 separate from a main storage compartment. The storage chamber 18 may be configured, such that cold air within a main storage compartment may be moved into the storage chamber 18, or may be insulated from the main storage compartment.

The storage chamber 18 may communicate with an opening 13 formed in a front surface of the door 12*a*. In this case, the sub door 100 may open or close the opening 13. The opening 13 may provide a passage through which the user may access the storage chamber 18. That is, the user may access the storage chamber 18 through the opening 13 in an open state of the sub door 100.

The refrigerator according to this embodiment may further include a tray 30 configured to be introduced into or withdrawn from the storage chamber 18, and a basket 120 placed on the tray 30. The tray 30 and the basket 120 may be accommodated in the storage chamber 18 when the sub door 100 closes the opening 13. On the other hand, the tray 30 and the basket 120 may be withdrawn toward the user by a predetermined distance when the sub door 100 opens the opening 13.

The basket 120 may be configured so as to be seated on an upper surface of the tray 30. The user may separate the basket 120 from the tray 30 to outwardly withdraw items stored in the basket 120. The basket 120 may store ice, for example.

The storage chamber 18 may be provided with a first guide rail 22, and the tray 30 may be provided with a second guide rail 32, movement of which may be guided by the first guide rail 22. The first guide rail 22 may horizontally extend above the second guide rail 32. More specifically, the first guide rail 22 may extend in a horizontal direction to protrude inward of the storage chamber 18, and the second guide rail 32 may extend in a horizontal direction to protrude downward and outward from the tray 30 to so as to be located below the first guide rail 22.

As the first guide rail 22 may downwardly push the second guide rail 32, it is possible to prevent the tray 30 from being tilted when the tray 30 is moved toward the opening 13. This is because vertical movement of the tray 30 may be restricted by the first guide rail 22 via engagement of the first guide rail 22 and the second guide rail 32.

As exemplarily shown in FIG. 2, the sub door 100 and the tray 30 are not connected to each other via, for example, a linkage.

Figure 4:
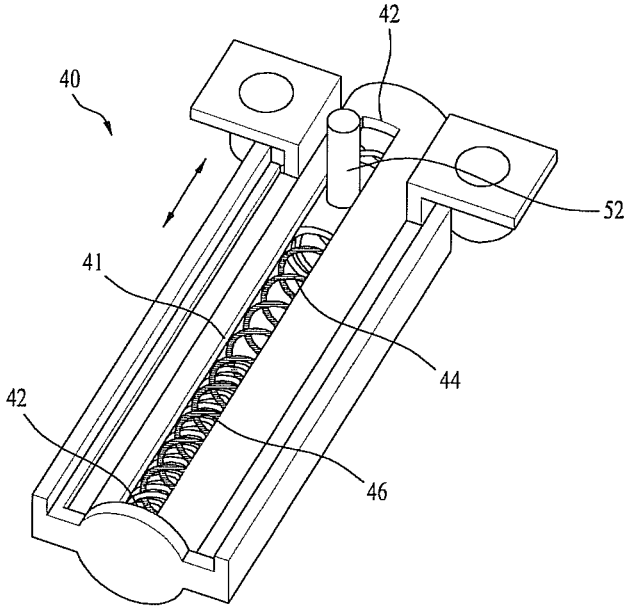
FIG. 4 is a view showing a guide according to one embodiment.

FIG. 4 is a view showing a guide according to an embodiment. A description with reference to FIG. 4 will follow.

The guide 40 may be installed to or at a lower surface of the storage chamber 18 and serve to guide movement of the tray 30. More specifically, the guide 40 may be compressed when the tray 30 is introduced into the storage chamber 18 and released from compression when the tray 30 is withdrawn from the storage chamber 18, to thereby guide movement of the tray 30.

The guide 40 may be provided with a coupling piece 52 configured to be coupled to the tray 30. The coupling piece may be pole-shaped, for example. The coupling piece 52 may be moved by two compressible springs, that is, a first compressible spring 44 and a second compressible spring 46. The guide 40 may have a slot 41 configured to guide linear movement of the coupling piece 52. As such, the slot 41 may serve to limit a movement trajectory of the guide 40.

The coupling piece 52 may be restricted, in terms of a movement range thereof, by stoppers 42 arranged at both ends of the slot 41. That is, the coupling piece 52 may be stopped upon reaching the stoppers 42. Accordingly, movement of the coupling piece 52 stops when the coupling piece 52 comes into contact with the stoppers 42, and then the coupling piece 52 may again be moved only in an opposite direction.

The first compressible spring 44 may be longer than the second compressible spring 46. When the coupling piece 52 is located at a specific position of or in the slot 41, the coupling piece 52 may compress only the first compressible spring 44, or may simultaneously compress both the first compressible spring 44 and the second compressible spring 46. The coupling piece 52 may be moved by less force while compressing only the first compressible spring 44, but may require a relatively greater force for movement thereof while simultaneously compressing both the first compressible spring 44 and the second compressible spring 46. Accordingly, a moving speed of the coupling piece 52 may vary according to a position thereof in the slot 41.

The first compressible spring 44 and the second compressible spring 46 may have different rigidities. This ensures that the first compressible spring 44 and the second compressible spring 46 have different displacements even if the same magnitude of force is applied thereto, which may cause variation in the moving speed of the coupling piece 52 in the slot 41. In particular, the first compressible spring 44 may have a less number of turns than that of the second compressible spring 46 on the basis of a same length thereof, so as to have different rigidities. Of course, even if the first compressible spring 44 and the second compressible spring 46 have the same rigidity, the first compressible spring 44 and the second compressible spring 46 having different lengths may cause variation in the moving speed of the coupling piece 52.

Figure 5:
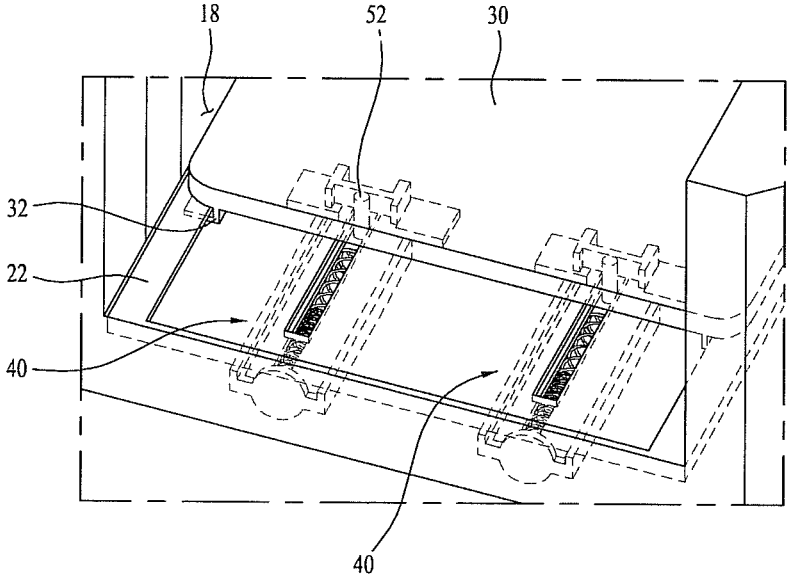
FIG. 5 is a view showing a state in which a tray is withdrawn from a storage chamber according to an embodiment.
Figure 6:
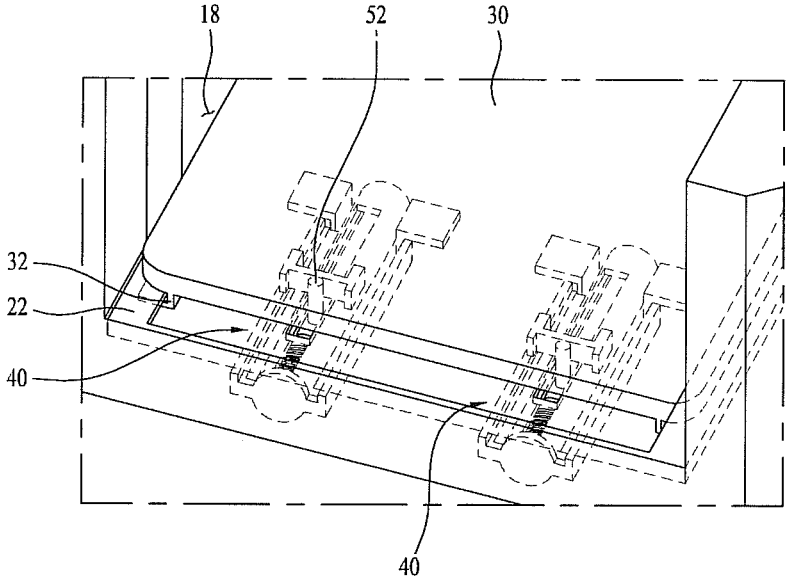
FIG. 6 is a view showing a state in which the tray of FIG. 5 is introduced into the storage chamber.

FIG. 5 is a view showing a state in which the tray is withdrawn from the storage chamber according to an embodiment, and FIG. 6 is a view showing a state in which the tray of FIG. 5 is introduced into the storage chamber. A description with reference to FIGS. 5 and 6 will follow. FIGS. 5 and 6 show a region opposite to an installed region of the sub door 100, that is, a region at a rear side of the storage chamber 18.

The coupling piece 52 of the guide 40 may be coupled to a lower surface of the tray 30. Thus, variation in the moving speed of the coupling piece 52 as described above may be equal to variation in the moving speed of the tray 30.

As exemplarily shown in FIG. 2, according to embodiments, no connection structure, such as a linkage, is present between the sub door 100 and the tray 30. Thus, when the user rotates the sub door 100 to open the opening 13, the tray 30 is moved from the state as exemplarily shown in FIG. 6 to a state as exemplarily shown in FIG. 5. On the other hand, if the user rotates the sub door 100 to close the opening 13, the sub door 100 pushes the tray 30, causing the tray 30 to be moved inward of the storage chamber 18 from the state as exemplarily shown in FIG. 5 to the state as exemplarily shown in FIG. 6.

In the state as exemplarily shown in FIG. 5, both the first compressible spring 44 and the second compressible spring 46 are released from compression. In the state as exemplarily shown in FIG. 6, both the first compressible spring 44 and the second compressible spring 46 are compressed.

As described above, as the first compressible spring 44 and the second compressible spring 46 have different lengths, the tray 30 has a greater moving speed when the tray 30 compresses both the first compressible spring 44 and the second compressible spring 46 or is moved by compressive force from both the first compressible spring 44 and the second compressible spring 46 than that when the tray 30 compresses the first compressible spring 44 or when moved by compressive force of the first compressible spring 44. That is, the guide 40 may cause variation in the moving speed of the tray 30.

Figure 7:
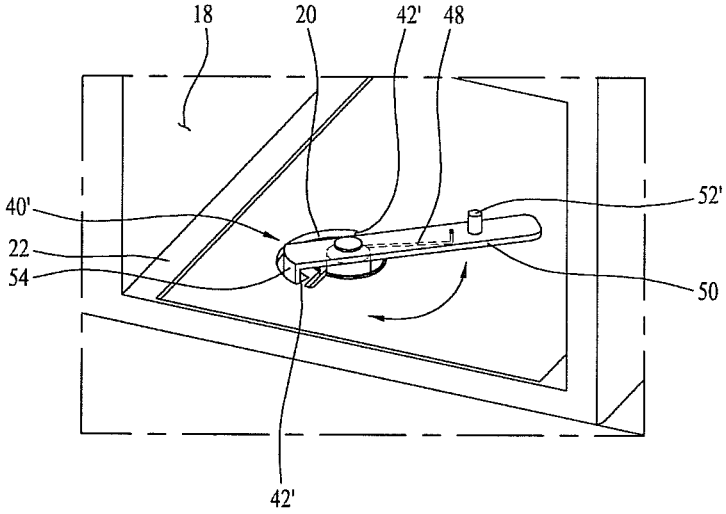
FIG. 7 is a view showing a guide according to another embodiment.

FIG. 7 is a view showing a guide according to another embodiment. A description with reference to FIG. 7 will follow.

A guide 40' according to this embodiment may include a torsion spring 48, which may be compressively deformable via rotation. That is, the torsion spring 48 may exhibit different deformation and compression based on a rotated position thereof.

According to this embodiment, the guide 40' may include a guide arm 50 coupled to one side of the torsion spring 48 to transmit torque of the torsion spring 48 to the tray 30. The guide arm 50 may be provided at an upper surface thereof with a coupling piece 52' configured to be inserted into a recess (51, see FIGS. 8 and 9) of the tray 30. The coupling piece 52' may take the form of a pole that protrudes substantially perpendicular to the guide arm 50.

A guide groove 20 may be formed in the storage chamber 18, and the guide arm 50 may have a guide protrusion 54 configured to be guided along the guide groove 20. In this case, the guide groove 20 may be formed in a bottom surface of the storage chamber 18.

The guide arm 50 may be rotated by the torsion spring 48. By converting rotation of the guide arm 50 into linear movement of the tray 30 in a withdrawal direction from the storage chamber 18, it will be appreciated that a linear moving speed of the tray 30 may vary based on a rotation angle of the guide arm 50. That is, owing to rotation of the guide arm 50, the tray 30 coupled to the guide arm 50 may substantially implement variable speed movement.

The guide protrusion 54 may be moved only along the guide groove 20, and therefore the guide groove 20 may define a movement trajectory of the guide arm 50. This may ensure stable rotation of the guide arm 50.

In addition, the guide groove 20 may have a gradient such that friction between the guide groove 20 and the guide protrusion 54 may vary based on a position of the guide protrusion 54. That is, a relatively shallow region of the guide groove 20 may apply a greater upward support force to the guide protrusion 54, whereas a relatively deep region of the guide groove 20 may apply a lesser upward support force to the guide protrusion 54. Accordingly, friction applied to the guide arm 50 may vary based on a position of the guide protrusion 54 in the guide groove 20.

Through the above described variation in friction between the guide protrusion 54 and the guide groove 20, the guide arm 50 may have different rates of rotation based on a position of the guide protrusion 54. Consequently, a linear moving speed of the tray 30 may vary based on a position of the guide protrusion 54.

Meanwhile, a stopper 42' may be provided at both ends of the guide groove 20 to restrict movement of the guide protrusion 54. That is, the guide protrusion 54 may stop movement in a given direction when coming into contact with the stoppers 42', and then may be moved in an opposite direction.

Figure 8:
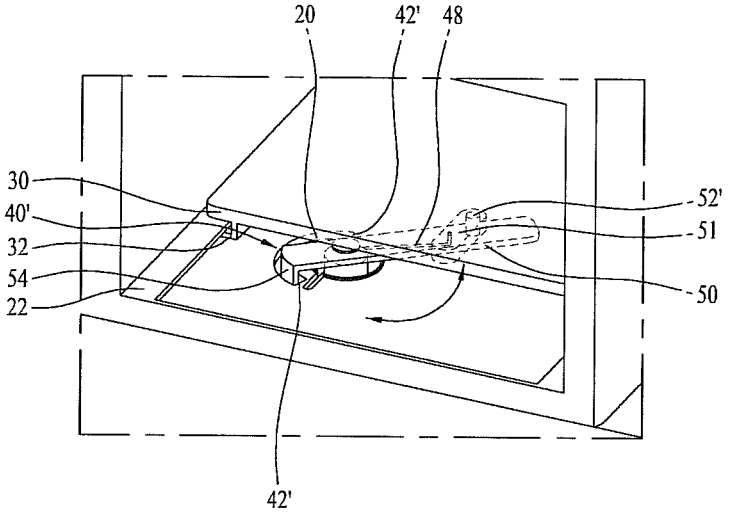
FIG. 8 is a view showing a state in which a tray of FIG. 8 is withdrawn from a storage chamber.
Figure 9:
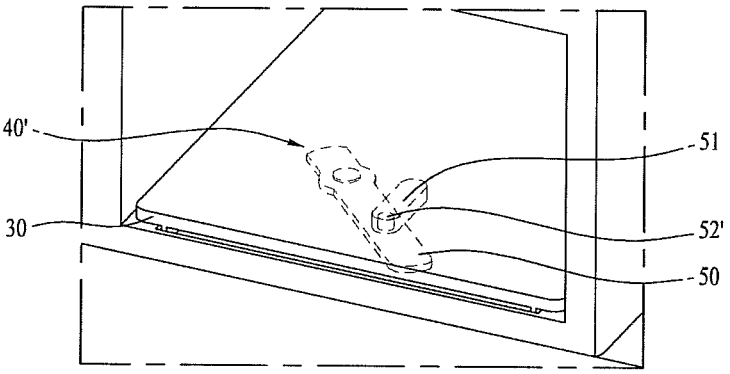
FIG. 9 is a view showing a state in which the tray of FIG. 8 is introduced into the storage chamber.

FIG. 8 is a view showing a state in which the tray of FIG. 7 is withdrawn from the storage chamber, and FIG. 9 is a view showing a state in which the tray of FIG. 8 is introduced into the storage chamber. A description with reference to FIGS. 8 and 9 will follow. FIGS. 8 and 9 show a region opposite to an installed region of the sub door 100, that is, a region at a rear side of the storage chamber 18.

The coupling piece 52' may be movably inserted into the recess 51. In this case, the recess 51 may be formed to extend substantially parallel to a width direction of the storage chamber 18 to change rotation of the coupling piece 52' into linear movement of the tray 30. That is, withdrawal or introduction of the tray 30 may occur via rotation of the guide arm 50.

FIG. 8 shows a state in which the torsion spring 48 is minimally compressed or not compressed, and FIG. 9 shows a state in which the torsion spring 48 is maximally compressed. As exemplarily shown in FIG. 2, according to embodiments, no connection structure, such as a linkage, is present between the sub door 100 and the tray 30. Thus, when the user rotates the sub door 100 to open the opening 13, the tray 30 may be moved from the state as exemplarily shown in FIG. 9 to the state as exemplarily shown in FIG. 8. On the other hand, if the user rotates the sub door 100 to close the opening 13, the sub door 100 may push the tray 30, causing the tray 30 to be moved inward of the storage chamber 18 from the state as exemplarily shown in FIG. 8 to the state as exemplarily shown in FIG. 9.

In particular, as the guide arm 50 compresses the torsion spring 48 via rotation thereof, a forward or reverse moving speed of the tray 30 may vary. In addition, as friction between the guide protrusion 54 and the guide groove 20 may vary, a moving speed of the tray 30 may vary according to a position of the tray 30.

Figure 10:
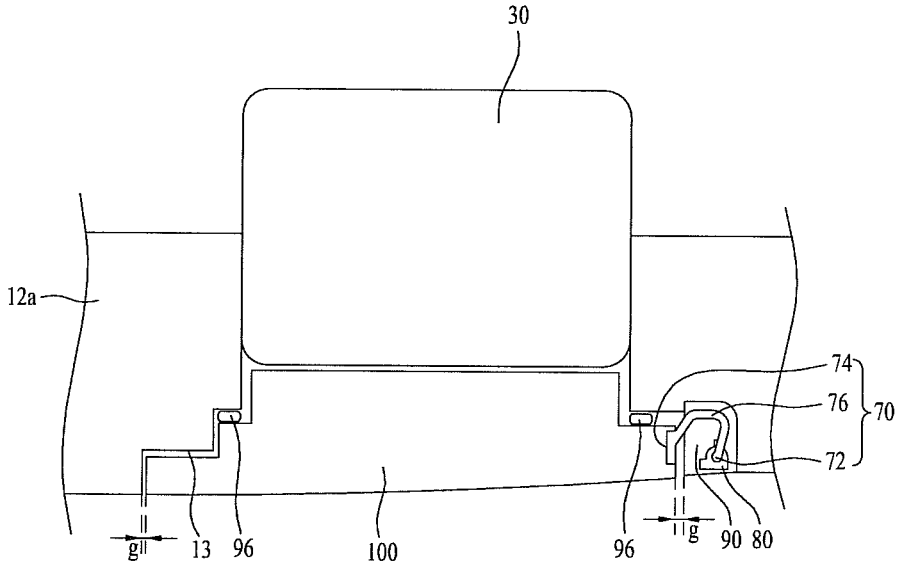
FIG. 10 is a sectional view taken along line X-X of FIG. 1.

FIG. 10 is a sectional view taken along line X-X of FIG. 1. A description with reference to FIG. 10 will follow.

The refrigerator according to embodiments may further include a sub hinge 70 configured to pivotally rotatably connect the sub door 100 and the door 12*a*. In this case, two sub hinges 70 may be arranged respectively at upper and lower ends of the sub door 100.

The door 12*a* may include an accommodation region 90 indented therein, the accommodation region 90 having a size suitable for installation of the sub hinge 70. The accommodation region 90 may be formed per the sub hinge 70 in a one to one ratio. Thus, when two sub hinges 70 are provided, two accommodation regions 90 may be formed. In particular, the accommodation region 90 may define a movement trajectory of the sub hinge 70. When the user rotates the sub door 100, a portion of the sub hinge 70 must be moved by a prescribed or predetermined angle within the accommodation region 90. This may serve to prevent the sub hinge 70 from interfering with the door 12*a* within the accommodation region 90.

Further, as shown in FIG. 10, first, second, and third steps 12*b*, 12*c*, and 12*d* may be provided at the opening 13. The sub door 100 may include a plurality of corresponding steps 100*a*, 100*b*, and 100*c*.

The sub hinge 70 may include a hinge shaft 72 coupled to the main door 12*a*, a coupling portion 74 coupled to the sub door 100, and a connection portion 76 that connects the hinge shaft 72 and the coupling portion 74 to each other. The sub hinge 70 may be rotated about the hinge shaft 72. The connection portion 76 may be bent at a plurality of positions thereof.

The sub door 100 may be installed such that a same gap g is defined between the sub door 100 and both ends of the opening 13. Due to the shape of the sub hinge 70, that is, the bent shape of the connection portion 76, the sub door 100 may have less interference with one end of the opening 13 during pivotal rotation thereof. Accordingly, due to the above described shape of the sub hinge 70, the sub door 100 may be centrally positioned in the opening 13, such that the same gap g is defined between both ends of the sub door 100 and both ends of the opening 13.

The user may recognize the sub door 100 as being centrally positioned in the opening 13 due to the same gap g between the sub door 100 and both ends of the opening 13.

This may advantageously provide the refrigerator with a more aesthetically pleasing outer appearance.

In addition, providing the same gap g at both sides may ensure symmetrical arrangement of sealants 96 used to prevent leakage of cold air from the gap g between the sub door 100 and the opening 13, which may provide manufacturing convenience. The sealants 96 may be rubber gaskets.

The hinge shaft 72 may be coupled to a limiter 80 and be installed in the accommodation region 90. The limiter 80 may function to limit a rotation angle of the sub hinge 70.

The accommodation region 90 and the sub hinge 70 may be arranged at the outside of a space which is sealed by the sealant 96, that is, arranged in a space at the outside of the storage chamber 18. In a state in which the sub door 100 closes the opening 13, the sealant 96 may prevent leakage of cold air between the sub door 100 and the opening 13. Accordingly, cold air of the storage chamber 18 may not reach the receptacle 90 and the sub hinge 70, and therefore insulation to prevent leakage of cold air may not be considered or needed upon design of the accommodation region 90 and the sub hinge 70. Further, as shown in FIG. 10, when the sub door 100 is closed, a front surface of the sub door 100 may be positioned on an extension line of a front surface of the main door 12*a*. Furthermore, as shown in FIG. 10, a tangential line at an edge of the front surface of the main door 12*a* may be identical to a tangential line at an edge of the front surface of the sub door 100.

Figure 11:
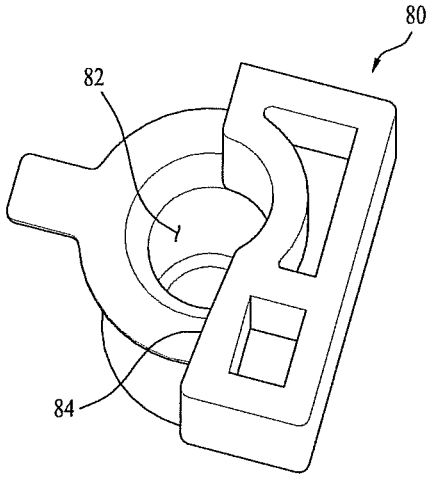
FIG. 11 is a perspective view of a limiter according to an embodiment.
Figure 12:
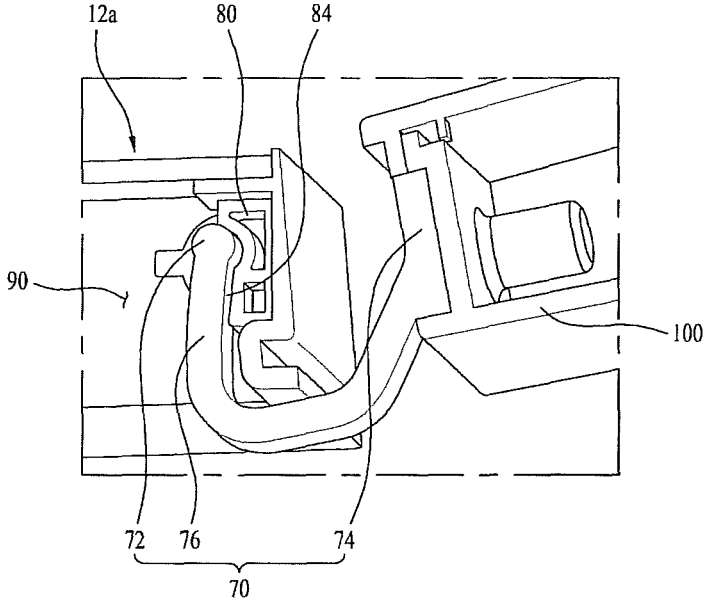
FIG. 12 is a view showing movement of the limiter of FIG. 11.

FIG. 11 is a perspective view of the limiter according to an embodiment, and FIG. 12 is a view showing movement of the limiter of FIG. 11. A description with reference to FIGS. 11 and 12 will follow.

The limiter 80 may be fitted into the accommodation region 90. The limiter 80 may have a hinge hole 82 into which the hinge shaft 72 may be rotatably inserted. The hinge hole 82 may be shaped to allow the cylindrical hinge shaft 72 to be rotatably inserted thereinto.

The limiter 80 may have a contact surface 84 configured to come into contact with the connection portion 76 so as to limit movement of the connection portion 76. In this case, the contact surface 84 may be a flat surface, and the connection portion 76, that is, the sub hinge 70 may be rotated no longer or further about the hinge shaft 72, thus stopping rotation when the connection portion 76 comes into contact with the contact surface 84.

That is, the contact surface 84 may serve to limit a maximum opening rotation angle of the sub door 100. Thus, even if the user tries to rotate the sub door 100 by a greater angle in a state in which the connection portion 76 comes into contact with the contact surface 84, the sub door 100 may be rotated no longer or further.

Although the limiter 80 limits the maximum rotation angle when the sub door 100 opens the opening 13, it is unnecessary to limit the maximum rotation angle when the sub door 100 closes the opening 13. This is because the sub door 100 comes into contact with one end of the opening 13, and thus, cannot be rotated toward the storage chamber 18 when the sub door 100 closes the opening 13.

Figure 13:
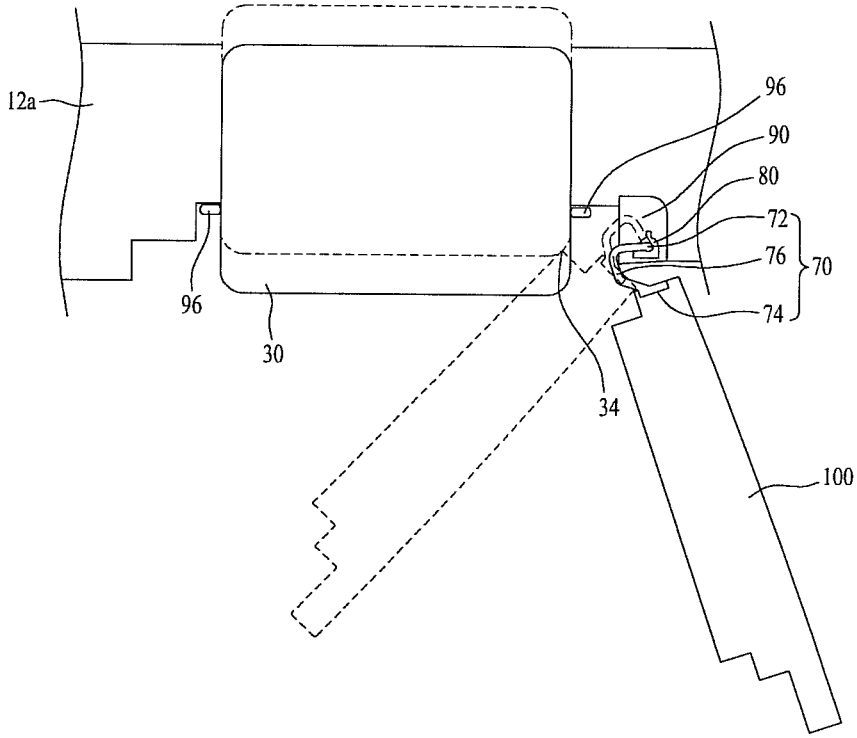
FIG. 13 is a view showing a state in which a sub door of FIG. 10 is open.

FIG. 13 is a view showing a state in which the sub door of FIG. 10 is open. A description with reference to FIG. 13 will follow.

In an open state of the sub door 100, no external force is applied to the guide 40 (40'), and thus, the guide 40 (40') is returned to an original form or state thereof without influence of compression. In such a non-compressed state of the guide 40 (40'), the tray 30 may be withdrawn from the storage chamber 18 by a predetermined distance.

As described above, a movement trajectory of the tray 30 may be limited by the stopper 42 (42'). Accordingly, the withdrawal distance of the tray 30 may be determined based on a position of the stopper 42 (42').

A rotation angle of the sub door 100 may be limited by the limiter 80, rather than the stopper 42 (42'). That is, when the sub door 100 is maximally rotated to open the opening 13, the sub door 100 does not come into contact with the tray 30. On the other hand, when the sub door 100 closes the opening 13 as exemplarily shown in FIG. 10, the sub door 100 comes into contact with the tray 30.

The tray 30 may include a contact portion 34 that comes into contact with the sub door 100. The contact portion 34 may be formed at a corner of the tray 30 and may be inclined by a prescribed or predetermined angle. When the contact portion 34 comes into contact with the sub door 100, the sub door 100 may guide movement of the tray 30.

The guide 40 may continuously apply a force required to withdraw the tray 30 from the storage chamber 18. Due to this force applied to the tray 30, the contact portion 34 may come into contact with the sub door 100 when the sub door 100 is rotated by a predetermined angle to open the opening 13.

According to embodiments disclosed herein, there is no mechanical connection structure, such as a linkage, between the sub door 100 and the tray 30. Accordingly, when the user begins to open the sub door 100 in a state in which the sub door 100 closes the opening 13, the contact portion 34 of the tray 30 comes into contact with the sub door 100, thereby causing the tray 30 to be withdrawn from the storage chamber 18. This is because the guide 40 (40') reserves compressive force in a state in which the sub door 100 closes the opening 13, and thus, may be deformed by a restoration force when an external force applied to the tray 30, that is, external force applied to the guide 40 varies. That is, as the sub door 100 is rotated to open the opening 13 by a greater degree, the restoration force of the guide 40 (40') may vary, thereby providing the tray 30 with a force required to rotate the sub door 100.

The contact portion 34 may come into contact with the sub door 100 until the tray 30 is moved by a predetermined distance required for maximum withdrawal thereof. Then, when the tray 30 is withdrawn by the predetermined distance, that is, is maximally withdrawn, movement of the tray 30 may stop, but the sub door 100 may be continuously rotated. That is, when the tray 30 is withdrawn by the predetermined distance, contact between the sub door 100 and the tray 30 may be released. That is, as the contact portion 34 no longer comes into contact with the sub door 100, the tray 30 may stop.

Figure 14:
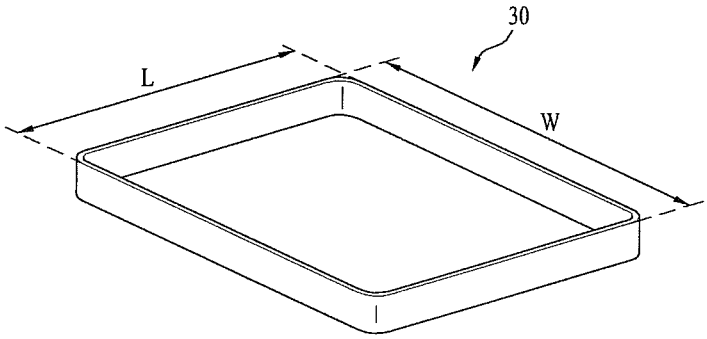
FIG. 14 is a view showing a tray according to embodiments.

FIG. 14 is a view showing the tray according to embodiments. A description with reference to FIG. 14 will follow.

The tray 30 may have a length L and a width W. According to embodiments disclosed herein, the tray 30 is not connected, that is, linked to the sub door 100, and vertical movement of the tray 30 may be restricted by the first guide rail 22 and the second guide rail 32.

Accordingly, there is no risk of the tray 30 tilting when the tray 30 is excessively withdrawn from the storage chamber 18, which may prevent spillage of items stored in the basket 120. That is, according to embodiments disclosed herein, the maximum withdrawal distance of the tray 30 may be set to approximately 0.6 times the length L of the tray 30, which may prevent problems due to excessive withdrawal of the tray 30.

Figure 15:
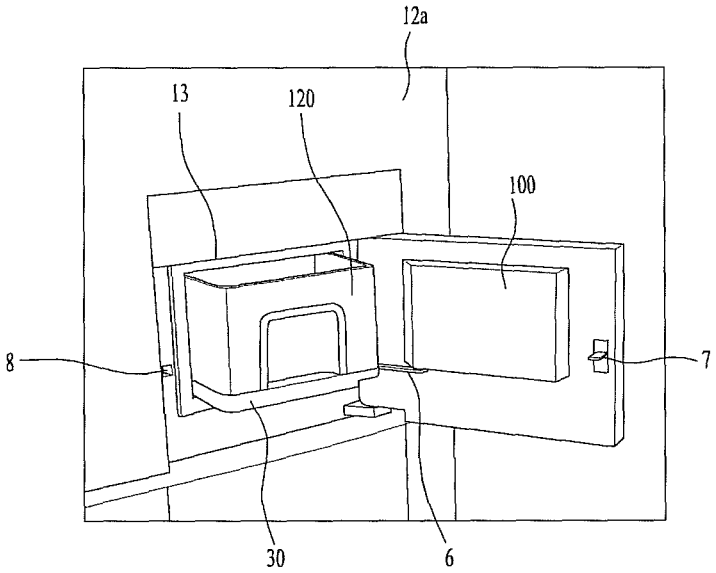
FIG. 15 is a view showing a front side of a main door in a state in which a sub door is open according to a further embodiment.

FIG. 15 is a view showing a front side of a main door in a state in which a sub door is open according to a further embodiment. A description with reference to FIG. 15 will follow.

According to this embodiment, a link 6 may be provided to connect the tray 30 and the sub door 100 to each other. In particular, according to this embodiment, the above described guide 40 (40') may be omitted. Of course, any one of the above described guides according to the previously described embodiments may be employed in this embodiment.

When the user rotates the sub door 100, the link 6 may be moved according to movement of the sub door 100, thereby causing the tray 30 to be moved forward toward the user by a predetermined distance. That is, the tray 30 is not moved forward with respect to the opening 13 in a closed state of the sub door 100, but may be moved forward with respect to the opening 13 in an open state of the sub door 100.

Accordingly, when the user opens the sub door 100, the tray 30 and the basket 120 may be moved even if the user does not retrieve the basket 120, which may provide user convenience.

As exemplarily shown in FIG. 15, a hook 7 and a latch 8 may be provided to fix the sub door 100 in a closed state thereof when the user closes the sub door 100. The hook 7 may be installed to an inner surface of the sub door 100 to protrude from the sub door 100. The latch 8 may take the form of a recess formed in the door 12*a* at a position corresponding to the hook 7, such that the hook 7 may be inserted into the latch 8. When the user pushes an outer surface of the sub door 100 at a position corresponding to the hook 7 and the latch 8, the hook 7 may be released from the latch 8 and the sub door 100 opened.

According to this embodiment, through this user behavior to open the sub door 100, the tray 30 and the basket 120 may be withdrawn forward without requiring additional user behavior to withdraw the tray 30 and the basket 120.

Embodiments disclosed herein are directed to a refrigerator that substantially obviates one or more problems due to limitation and disadvantages of the related art.

Embodiments disclosed herein provide a refrigerator which may allow a user to conveniently use a tray accommodated in a main door.

Embodiments disclosed herein provide a refrigerator that may include a main body having a storage compartment in which food or other items may be stored, a main door configured to open or close the storage compartment, the main door having a storage chamber separate from the storage compartment, a sub door configured to open or close an opening of the storage chamber, a tray configured to be introduced into or withdrawn from the storage chamber, a guide unit or guide configured to guide movement of the tray by being compressed when the tray is introduced into the storage chamber and released from compression when the tray is withdrawn from the storage chamber, and a basket placed on the tray, the basket having a storage space therein. The guide unit may cause variation in a moving speed of the tray when the tray is introduced or withdrawn.

The tray may include a contact portion configured to come into contact with the sub door. The sub door may guide movement of the tray when the contact portion comes into contact with the sub door.

The guide unit may include a first compressible spring and a second compressible spring, and the first compressible spring may be longer than the second compressible spring. The first compressible spring and the second compressible spring may have different rigidities. The first compressible spring may have a less number of turns than that of the second compressible spring on the basis of the same length.

The guide unit may include a torsion spring configured to be compressed via rotation. The guide unit may further include a guide arm coupled to one side of the torsion spring to transmit torque of the torsion spring to the tray.

The storage chamber may have a guide groove, and the guide arm may include a guide protrusion configured to be guided along the guide groove. The guide groove may have a gradient such that friction between the guide groove and the guide protrusion varies based on a position of the guide protrusion.

The storage chamber may include a first guide rail, and the tray may include a second guide rail, movement of which may be guided by the first guide rail.

The tray may be configured to be withdrawn from the storage chamber by a predetermined distance, and the predetermined distance may be approximately 0.6 times a length of the tray. Contact between the sub door and the tray may be released when the tray is withdrawn by the predetermined distance.

Embodiments disclosed herein further provide a refrigerator that may include a main body having a storage compartment in which food or other items may be stored, a main door configured to open or close the storage compartment, the main door having a storage chamber separate from the storage compartment, a sub door configured to open or close an opening of the storage chamber, and a sub hinge configured to pivotally rotatably connect the sub door to the main door. The sub hinge may include a hinge shaft coupled to the main door, a coupling portion coupled to the sub door, and a connection portion that connects the hinge shaft and the coupling portion to each other. The connection portion may be bent at a plurality of positions thereof.

The refrigerator may further include a limiter configured to limit a rotation angle of the sub door. The limiter may include a contact surface configured to come into contact with the connection portion so as to limit movement of the connection portion. The contact surface may limit a maximum opening rotation angle of the sub door.

The main door may include an accommodation region indented therein to provide a movement trajectory of the sub hinge. The refrigerator may further include a sealant configured to seal a gap between the storage chamber and the sub door, and the accommodation region may be located at the outside of a space sealed by the sealant. The refrigerator may further include a sealant configured to seal a gap between the storage chamber and the sub door, and the sub hinge may be located at the outside of a space sealed by the sealant.

It will be apparent that, although embodiments have been shown and described above, embodiments are not limited to the above-described specific embodiments, and various modifications and variations can be made by those skilled in the art without departing from the gist of the appended claims. Thus, it is intended that the modifications and variations should not be understood independently of the technical sprit or prospect.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a main body having a first storage compartment;

a main door to open or close the first storage compartment, the main door having an opening, a first step and a second step provided on a first edge of the opening, and a third step provided on a second edge of the opening;

a sub door to open and close the opening of the main door, the sub door having a plurality of steps provided at both side of the sub door, respectively;

a sealant mounted on at least one of the first, second, and third steps of the main door or one of the plurality of steps of the sub door;

a shaft receiving member mounted on the third step of the main door; and a sub hinge that connects the sub door to the main door, wherein the sub hinge includes:

a hinge shaft pivotally coupled to the shaft receiving member;

a coupling portion mounted to a lateral side portion of one of the plurality of steps of the sub door, wherein the lateral side portion faces the hinge shaft; and a connection portion that connects the hinge shaft and the coupling portion to each other, wherein the connection portion has a bent portion, wherein when the sub door is closed, a front surface of the sub door is positioned on an extension line of a front surface of the main door, and wherein a number of steps of the plurality of steps provided on one side of the sub door is different from a number of steps of the plurality of steps provided on an opposite side of the sub door.

2. The refrigerator according to claim 1, wherein the shaft receiving member includes a limiter to limit a rotational angle of the sub door.

3. The refrigerator according to claim 2, wherein the limiter includes a contact surface configured to come into contact with the connection portion so as to limit movement of the connection portion.

4. The refrigerator according to claim 3, wherein the contact surface limits a maximum opening rotational angle of the sub door.

5. The refrigerator according to claim 1, wherein the main door includes an accommodation region indented therein to provide a movement trajectory of the sub hinge.

6. The refrigerator according to claim 5, wherein the sealant is configured to seal a gap between the main door and the sub door, wherein the accommodation region is located at an outside of a space sealed by the sealant.

7. The refrigerator according to claim 5, wherein the sealant is configured to seal a gap between the main door and the sub door, and wherein the sub hinge is located at an outside of a space sealed by the sealant.

8. The refrigerant according to claim 1, wherein the sealant is installed on the second step.

9. The refrigerator according to claim 8, wherein the sealant is installed on a front surface of the second step.

10. The refrigerator according to claim 1, wherein the first step is in front of the second step.

11. The refrigerator according to claim 1, wherein the second step is closer to the third step than the first step.

12. The refrigerator according to claim 1, wherein a tangential line at an edge of the front surface of the main door is identical to a tangential line at an edge of the front surface of the sub door.

13. The refrigerator according to claim 12, wherein a gap is provided between the edge of the front surface of the main door and the edge of the front surface of the sub door.

14. The refrigerator according to claim 1, wherein the plurality of steps of the sub door includes a fourth step and a fifth step opposite to the first and second steps, respectively, and a sixth step opposite to the third step.

15. A refrigerator, comprising:

a main body having a first storage compartment;

a main door to open and close the first storage compartment, the main door having an opening, a first step and a second step provided on a first edge of the opening, and a third step provided on a second edge of the opening;

a sub door to open and close the opening of the main door, the sub door having a plurality of steps provided at both sides of the sub door, respectively;

a sealant mounted on at least one of the first, second, and third steps of the main door or one of the plurality of steps of the sub door;

a shaft receiving member mounted on the third step of the main door; and a sub hinge that connects the sub door to the main door, wherein the sub hinge includes:

a hinge shaft pivotally coupled to the shaft receiving member;

a coupling portion mounted to a lateral side portion of one of the plurality of steps of the sub door, wherein the lateral side portion faces the hinge shaft; and a connection portion that connects the hinge shaft and the coupling portion to each other, wherein the connection portion has a bent portion, wherein when the sub door is closed, a front surface of the sub door is positioned on an extension line of a front surface of the main door, and wherein more steps of the plurality of steps are provided on a side of the sub door which is farther away from the hinge shaft than a side of the sub door adjacent to the hinge shaft.

16. The refrigerator according to claim 1, further including:

a tray configured to be introduced or withdrawn through the opening of the main door.

17. The refrigerator according to claim 15, further including:

a basket configured to be placed on the tray, the basket having a storage space therein.

18. The refrigerator according to claim 15, wherein the main door includes a first guide rail, and wherein the tray includes a second guide rail, movement of which is guided by the first guide rail.

* * * * *